US007267578B2

(12) United States Patent
Wu

(10) Patent No.: US 7,267,578 B2
(45) Date of Patent: Sep. 11, 2007

(54) ELECTRICAL CONNECTOR ASSEMBLY HAVING IMPROVED LOCKING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,713

(22) Filed: Dec. 30, 2005

(65) Prior Publication Data

US 2007/0099504 A1 May 3, 2007

(30) Foreign Application Priority Data

Oct. 31, 2005 (CN) ..... 200520076971.0

(51) Int. Cl.
*H01R 13/648* (2006.01)

(52) U.S. Cl. ..... 439/607

(58) Field of Classification Search ..... 439/353, 439/354, 357, 449, 465, 607
See application file for complete search history.

(56) References Cited

U.S. PATENT DOCUMENTS 4,421,376 A 12/1983 Cosmos et al.
6,171,136 B1 1/2001 Liu et al.

FOREIGN PATENT DOCUMENTS

CN 200420006070 6/2005

*Primary Examiner*—Khiem Nguyen
(74) *Attorney, Agent, or Firm*—Wei Te Chung

(57) ABSTRACT

An electrical connector assembly (100) includes a first insulative housing (1), a connector body (200) received in the first insulative housing (1), a cable (7) and an insulative cover (9) assembled with the first insulative housing (1). The connector body further includes a shielding member (2), a second insulative housing (3) received in the shielding member, and a plurality of contacts (4, 5) received in the second insulative housing. The cable electrically connects with at least a contact. The electrical connector assembly further defines a rear-to-front direction. The first insulative cover is assembled with the first insulative housing in the rear-to-front direction, thereby forming a locking mechanism therebetween for locking them reliably.

19 Claims, 10 Drawing Sheets

ELECTRICAL CONNECTOR ASSEMBLY HAVING IMPROVED LOCKING MECHANISM

BACKGROUND OF THE INVENTION

1. Field of the Invention

The present invention relates generally to an electrical connector assembly, and more particularly to an electrical connector assembly for transmitting high speed signals in a interconnection system.

2. Description of Related Arts

With the development of communication and computer technology, many electrical connectors with conductive elements are desired to construct a large number of signal transmitting paths between two electrical devices. Such electrical connectors are widely used in connecting systems of electrical devices and the like devices requiring data processing and communication.

For example, U.S. Pat. No. 6,171,136B1 which issued to Northstar Farest on Jan. 9, 2001 shows a male type USB (Universal Serial Bus) connector comprising a connector body, a cable connected to the connector body, two symmetrical insulating shells fastened together and covered on the lateral side walls and rear side wall of the connector body and a part of the cable to secure the cable to the connector body, an insulating cap fastened to front portions of the connector body and the insulating shells, and two packing strips mounted between the backward coupling flange of the cap and the top, bottom side walls of the connector body.

However, said electrical connector in use needs to plug into or unplug from the complementary connector frequently, thereby causing two packing strips easy to escape from said electrical connector. In addition, in a vibrative circumstance, two packing strips are easy to loose and cannot inferentially mount said insulating cap with the connector body. Thus, a reliable connection between said electrical connector and the complementary connector is affected.

Chinese Patent Application No. 200420006070.X which published on Jun. 22, 2005 also shows an electrical connector comprising a shell, an insulative housing, a plurality of terminals received in the insulative housing, and a spacer. The insulative housing is received in the shell, the spacer is pushed into the shell in a back-to-front direction, thereby sealing the back of the shell.

However, said electrical connector does not have insulative shell for completely covering the shell and preventing the shell from distorting in an occasional collision with other elements. In addition, for positioning in and fixing with the shell, both the insulative housing and the spacer should form additional engaging elements for mating with corresponding elements formed on the shell. But, there is not a fastening member for fixing these three together and reliably. In a vibrative circumstance, these three elements are likely to loose from one another and influence electrical connection.

Hence, an electrical connector assembly having improved locking mechanism is desired.

SUMMARY OF THE INVENTION

Accordingly, the object of the present invention is to provide an electrical connector assembly having improved locking mechanism, thereby, assuring a reliable connection.

The Another object of the present invention is to provide an electrical connector assembly having improved housing for preventing the connector assembly from distorting.

To achieve the above objects, an electrical connector assembly in according with the present invention comprises a first insulative housing, a connector body received in the first insulative housing, at least a cable and an insulative cover assembled with the first insulative housing. The connector body further comprises a shielding member, a second insulative housing received in the shielding member, and a plurality of contacts received in the second insulative housing. A cable electrically connects with at least a contact. In addition, the electrical connector assembly further defines a rear-to-front direction. The first insulative cover is assembled with the first insulative housing in the rear-to-front direction, thereby forming a locking mechanism therebetween for locking them reliably.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
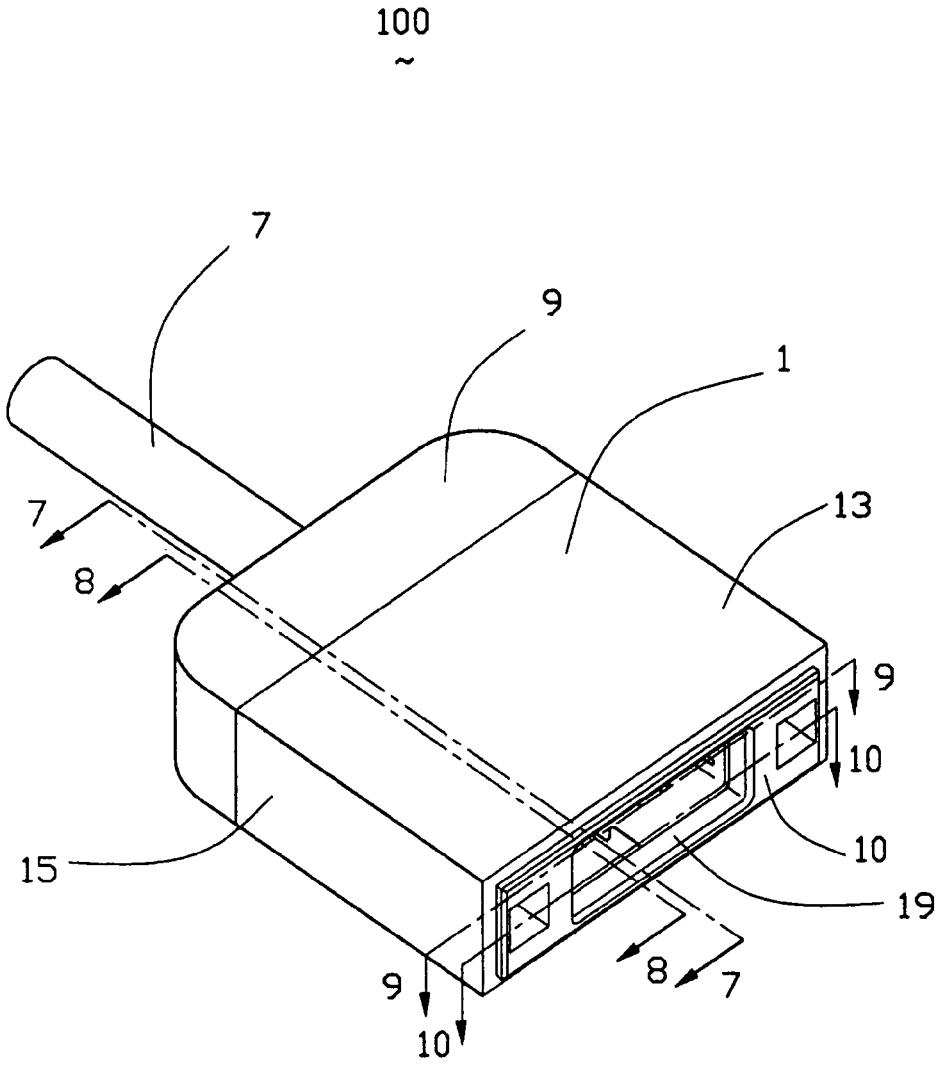
FIG. 1 is a perspective, assembled view of an electrical connector assembly in accordance with the present invention.

Referring to FIGS. 1-6, an electrical connector assembly 100 in accordance with the present invention comprises a first insulative housing 1, a connector body 200 received in the first insulative housing 1, a spacer 6 coupled to the connector body 200, at least a cable 7, a casing 8 partially enclosing the rear end of the connector body 200, the spacer 6 and the front end of the cable 7, and an insulative cover 9 assembled with the first insulative housing 1 in a rear-to-front direction. The connector body 200 further comprises a shielding member 2, a second insulative housing 3 received in the shielding member 2, and a plurality of first and second contacts 4, 5 received in the second insulative housing 3 and electrically connected with the cable 7.

The first insulative housing 1 with a substantially rectangular configuration, comprises a first front surface 10, a first rear surface 11 opposite to the first front surface 10, a first top wall 13 disposed between the first front surface 10 and the first rear surface 11, a first bottom wall 14 opposite to the first top wall 13, and two opposite lateral walls 15 connecting with the first top and bottom walls 13, 14. These walls together define a receiving cavity (not labeled) for receiving the connector body therein. A pair of first inner walls 17 parallel to opposite lateral walls 15 (in conjunction with FIG. 9) is disposed in the receiving cavity for partitioning the receiving cavity into a first cavity 19, a second cavity 12 communicating with the first cavity 19, and a pair of first channels 18 respectively formed between the first inner walls 17 and the lateral walls 15. The first channels 18 respectively permeate the first insulative housing 1 from the first front surface 10 towards the first rear surface 11. A pair of locking portions 150 (in conjunction with FIG. 9) with a ladder configuration is respectively formed on the inner surface of the first lateral walls 15. A pair of restrictive portions 16 with a ladder configuration is respectively formed on the inner surface of the first inner walls 17 and adjacent to the first front surface 10. A plurality of posts 110 respectively projects rearwardly from the first rear surface 11, a plurality of ribs 111 are respectively formed on each post 110 for providing a friction function with the insulative cover 9.

Figure 4:
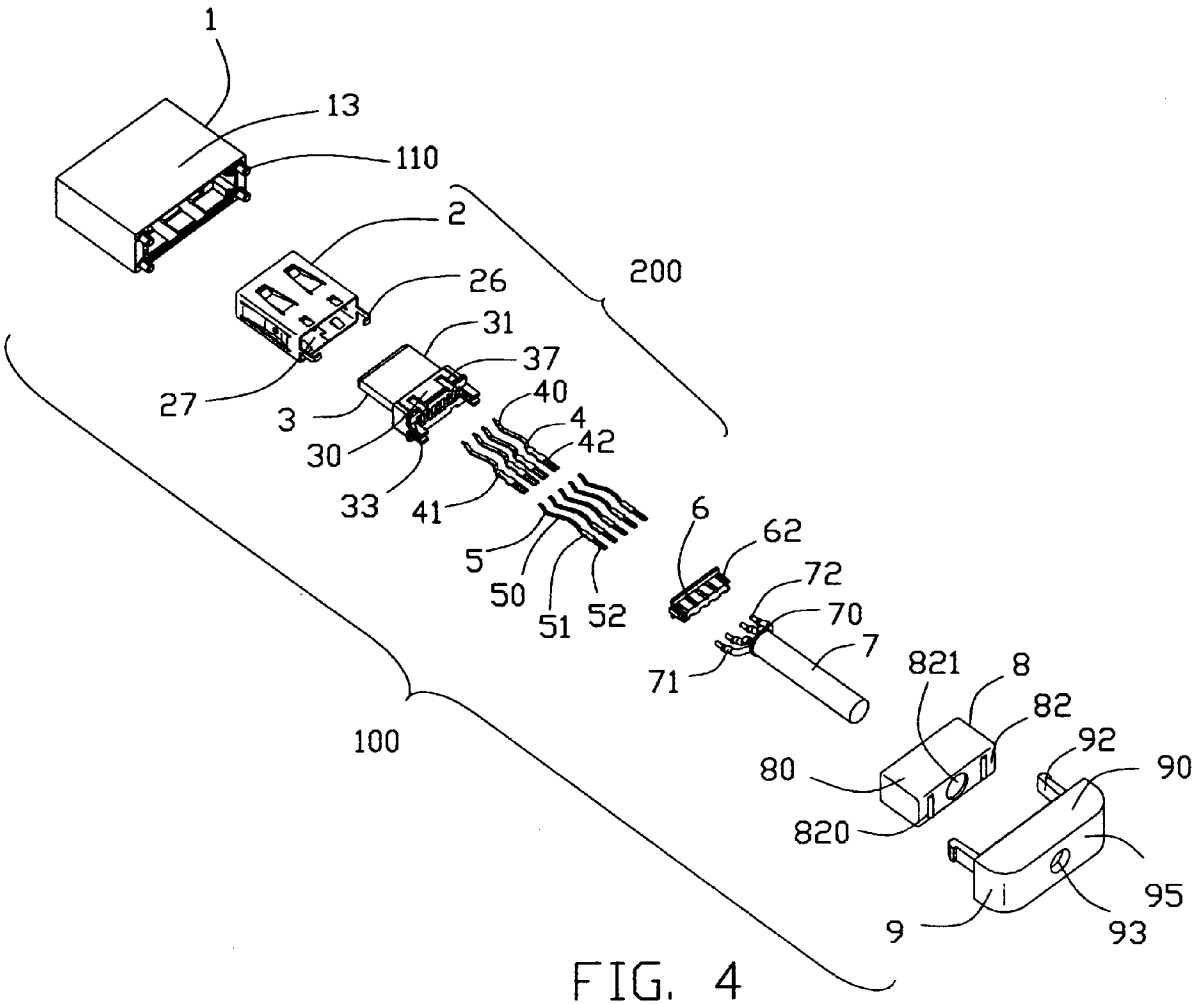
FIG. 4 is a perspective, exploded view of the electrical connector assembly of FIG. 1.
Figure 5:
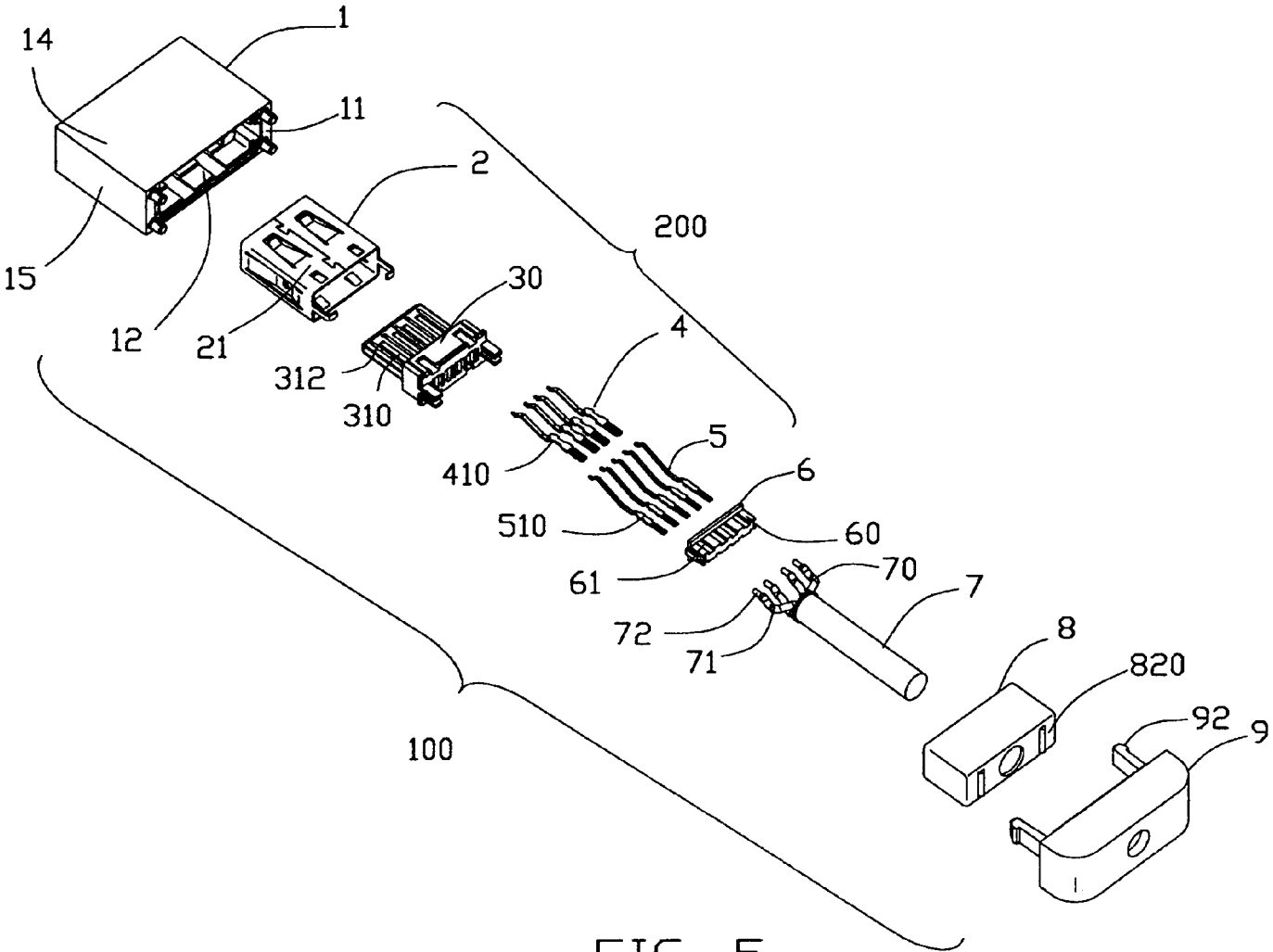
FIG. 5 is a view similar to FIG. 4, but taken from a different aspect.

Referring to FIG. 4 in conjunction with FIG. 5, the shielding member 2 is generally stamped from a piece of metal or other conductive materials. The shielding member 2 is in an elongate frame shape for substantially shielding the second insulative housing 3. The shielding member 2 comprises a second top wall 20, a second bottom wall 21 opposite to the second top wall 20, and a pair of second lateral walls 22 connecting with the second top and bottom walls 20, 21. These walls together define a third cavity 27 for receiving the second insulative housing 3 therein. The second top and bottom walls 20, 21 respectively define a pair of first resilient pieces 23 protruding inwardly therefrom for electrically engaging with a corresponding element of complementary connector (not shown) when the electrical connector assembly 100 is assembled with the complementary connector, and a pair of second resilient pieces 24 aligning with corresponding first resilient pieces 23 in the rear-to-front direction. Each second lateral wall 22 defines a pair of third resilient pieces 25 protruding inwardly therefrom for fixing the electrical connector assembly 100 with the complementary connector reliably, and a pair of locking barbs 26 respectively extending rearwardly therefrom for locking with the second insulative housing 3 and the spacer 6. Attentively, before an assembly process, the locking barb 26 is an l-shaped configuration. During the assembly process, the locking barb 26 will be bended from an l-shaped configuration into an L-shaped configuration for fastening the second insulative housing 3 and the spacer 6 with the shielding member 2.

Figure 6:
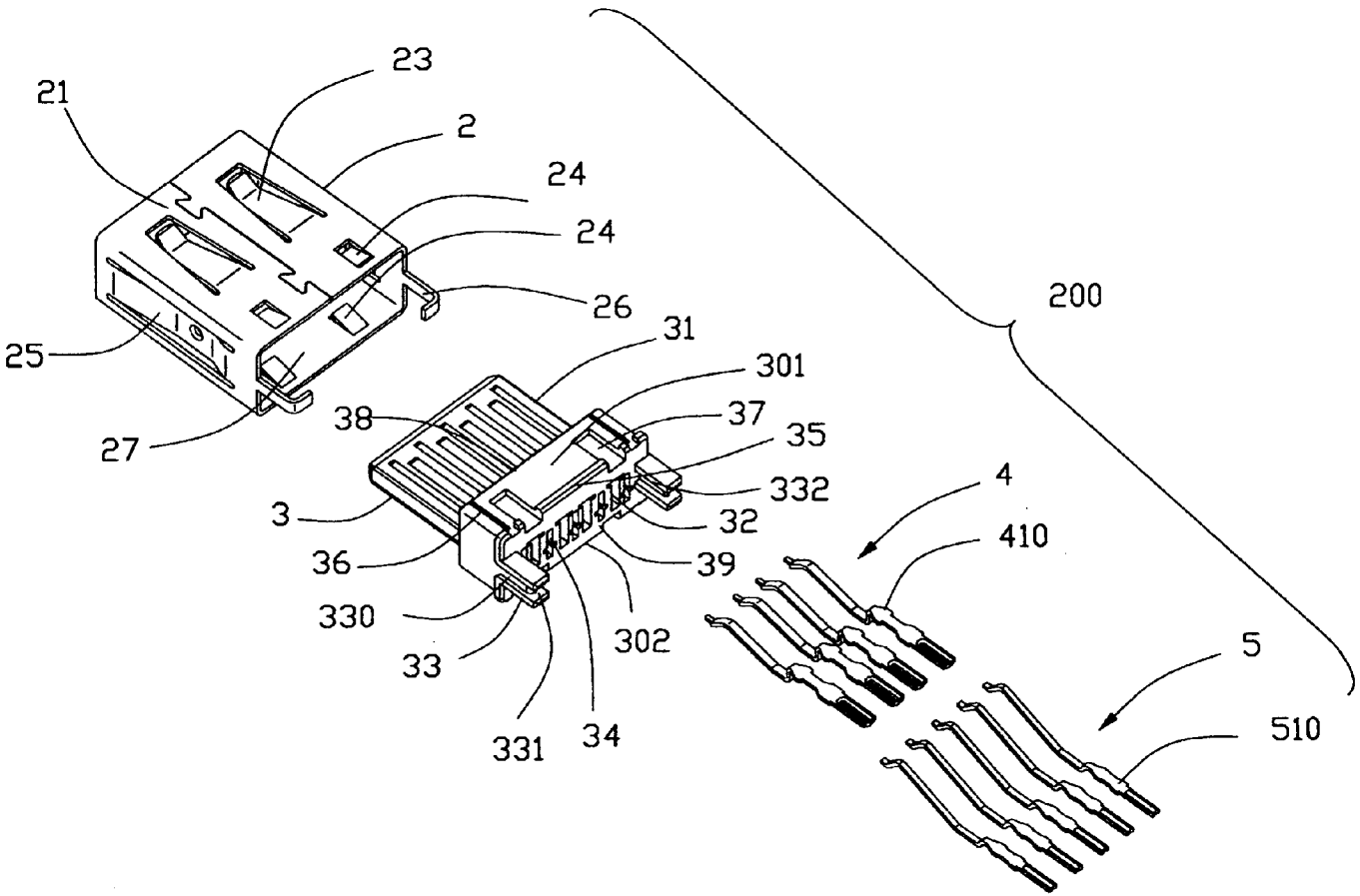
FIG. 6 is a perspective, exploded view of the connector body of the electrical connector assembly in accordance with the present invention.

Referring to FIGS. 4-6, the second insulative housing 3 comprises a base 30, a tongue 31 extending forwardly from a front surface 38 of the base 30, and a pair of stretching portions 33 extending rearwardly from a rear surface 39 of the base 30. The base 30 further comprises a plurality of first contact receiving passageways 32 and a plurality of second contact receiving passageways 34 arranged alternately with the first contact receiving passageways 32, which all permeating through the base 30 from the front surface 38 to the rear surface 39, for allowing the first contacts 4 and the second contacts 5 extending therethrough. The base 30 also defines a pair of locking slots 37 respectively disposed on the top and bottom surfaces 302, 301 and extending from the rear surface 39 towards the front surface 38 for allowing the second resilient pieces 24 engaging therewith, a baffle 35 respectively disposed on the rear edges of the top and bottom surfaces 302, 301 and extending in a direction perpendicular to the rear-to-front direction, and a pair of ribs 36 disposed on two lateral edges of top and bottom surfaces 302, 301 and extending in a direction parallel to the rear-to-back direction for interferentially engaging with corresponding inner surfaces of the shielding member 2. The tongue 30 with a flat board configuration, comprises a plurality of first contact slots 310 aligning with the first contact passageways 32 and a plurality of second contact slots 312 aligning with the second contact passageways 34 and arranged alternately with the first contact slots 310 for respectively allowing the first and second contacts 4, 5 positioned therein. Each stretching portion 33 comprises a restricted slit 330 disposed in the outer wall thereof for allowing the locking barb 26 extending therethrough, a guiding slit 332 disposed in the inner wall thereof for guiding the spacer 6 to insert in, and a locking slit 331 communicating with the restricted slit 330 and the guiding slit 332 and provided for the locking barb 26 locking with.

Figure 2:
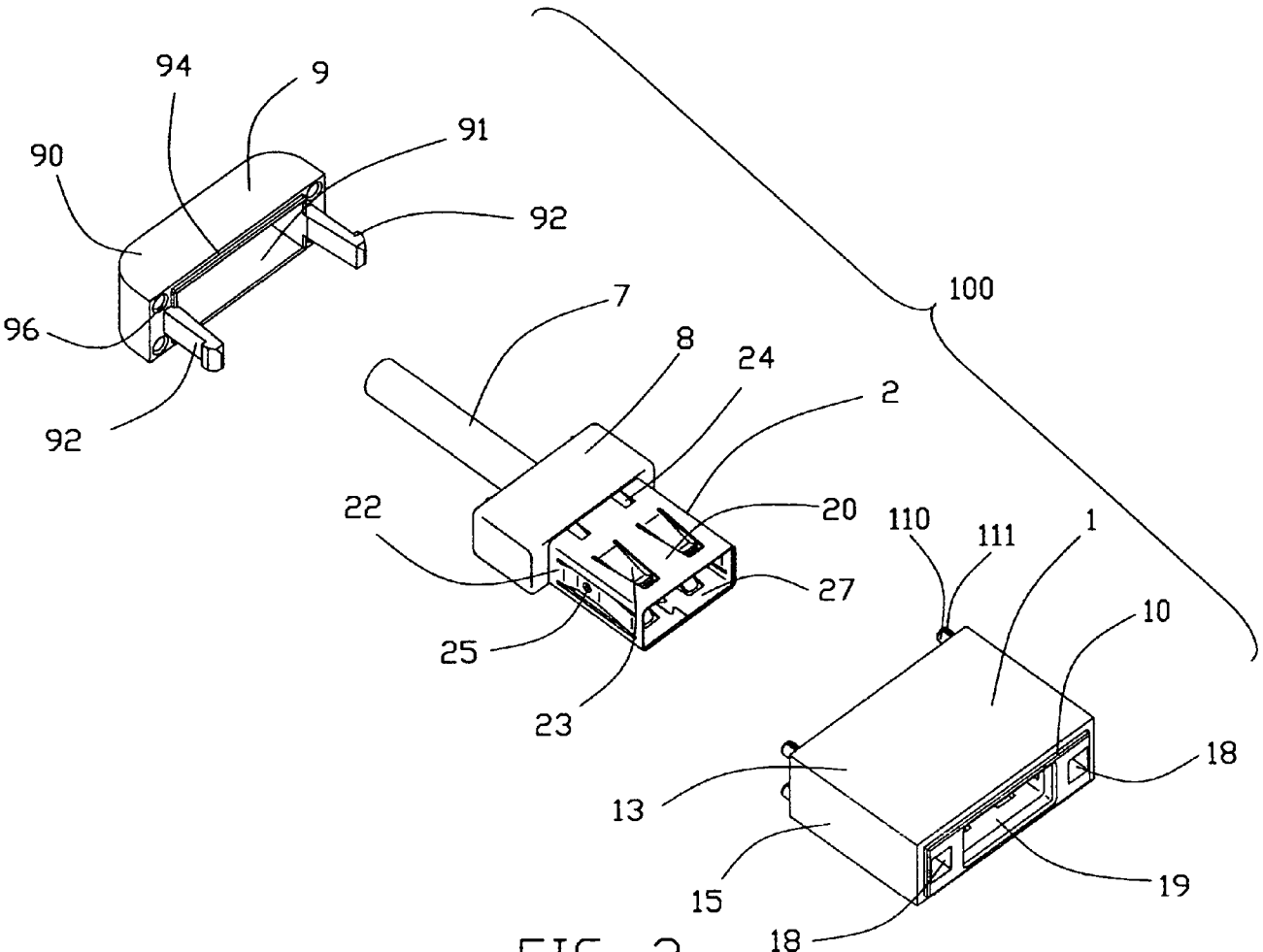
FIG. 2 is a partially, exploded view of the electrical connector assembly of FIG. 1, showing the cable electrically connected to the connector body.
Figure 3:
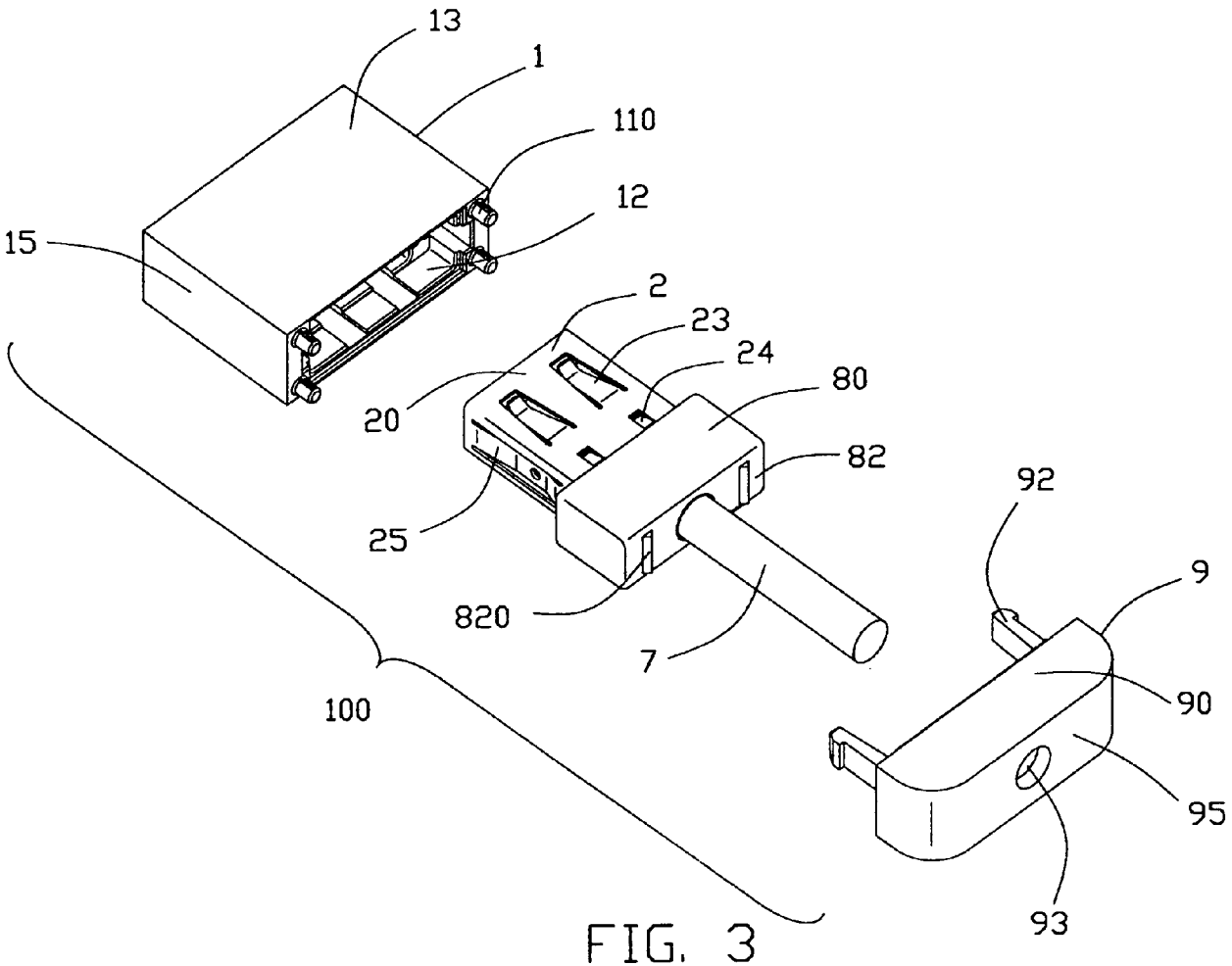
FIG. 3 is a view similar to FIG. 2, but taken from a different aspect.

Referring to FIGS. 2-4, each first contact 4 comprises a first mating end 40 for electrically mating with corresponding contact of the complementary connector, a first tail end 42 for electrically connecting to the cable 7 and a first retention portion 41 connected with the first mating end 40 and the first tail end 42. Each first retention portion 41 defines a plurality of first stings 410 disposed on two sides thereof for providing a retention function.

Referring to FIGS. 2-4, each second contact 5 comprises a second mating end 50 for electrically mated with corresponding contact of complementary connector, a second tail end 52 for electrically connected to the cable 7 and a second retention portion 51 connected with the first mating end 50 and the first tail end 52. Each first retention portion 51 defines a plurality of second stings 510 disposed on two sides thereof for provided a retention function.

Figure 9:
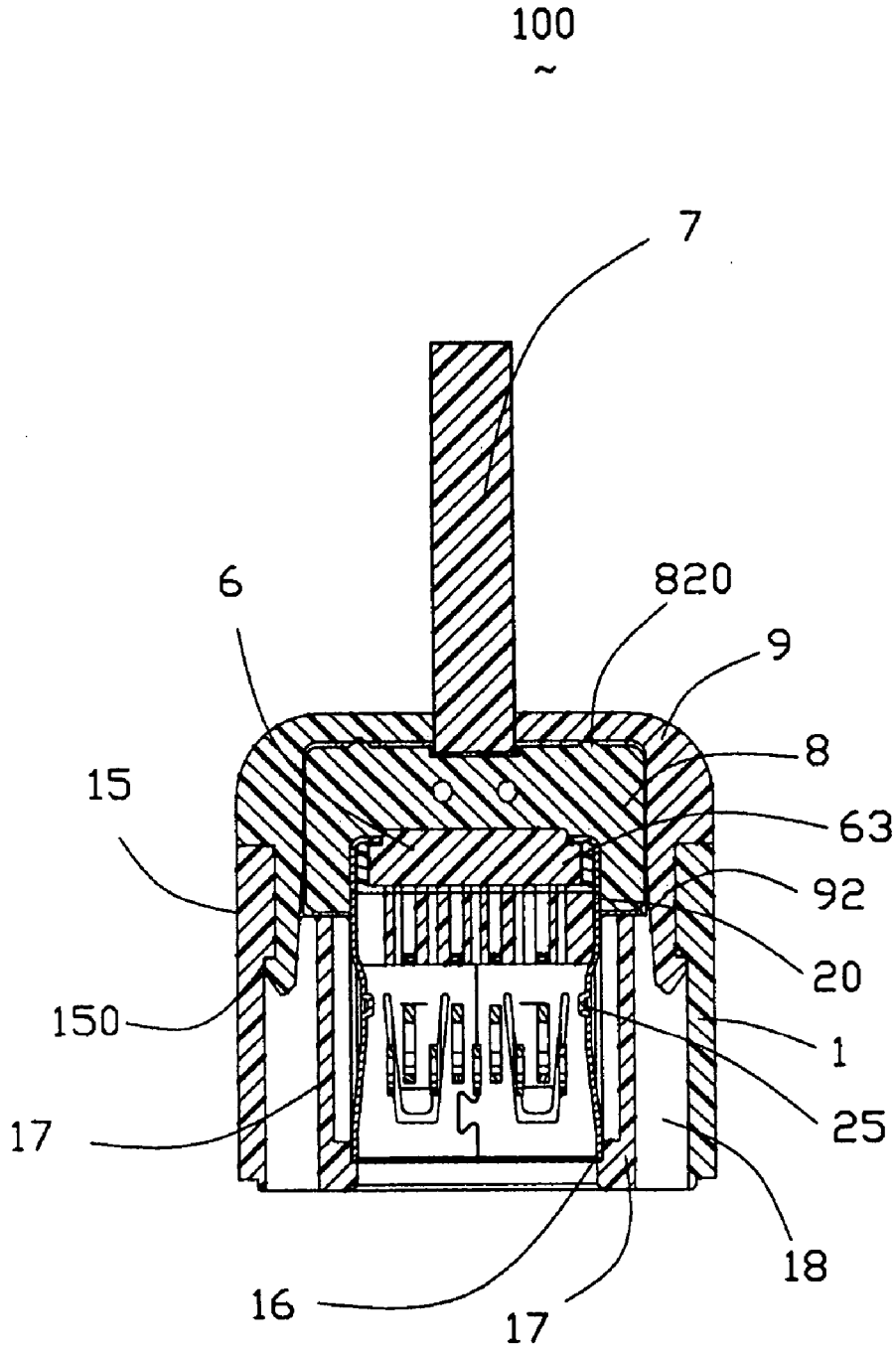
FIG. 9 is a cross sectional view of the electrical connector assembly of FIG. 1 taken along line 9-9 of FIG. 1.
Figure 10:
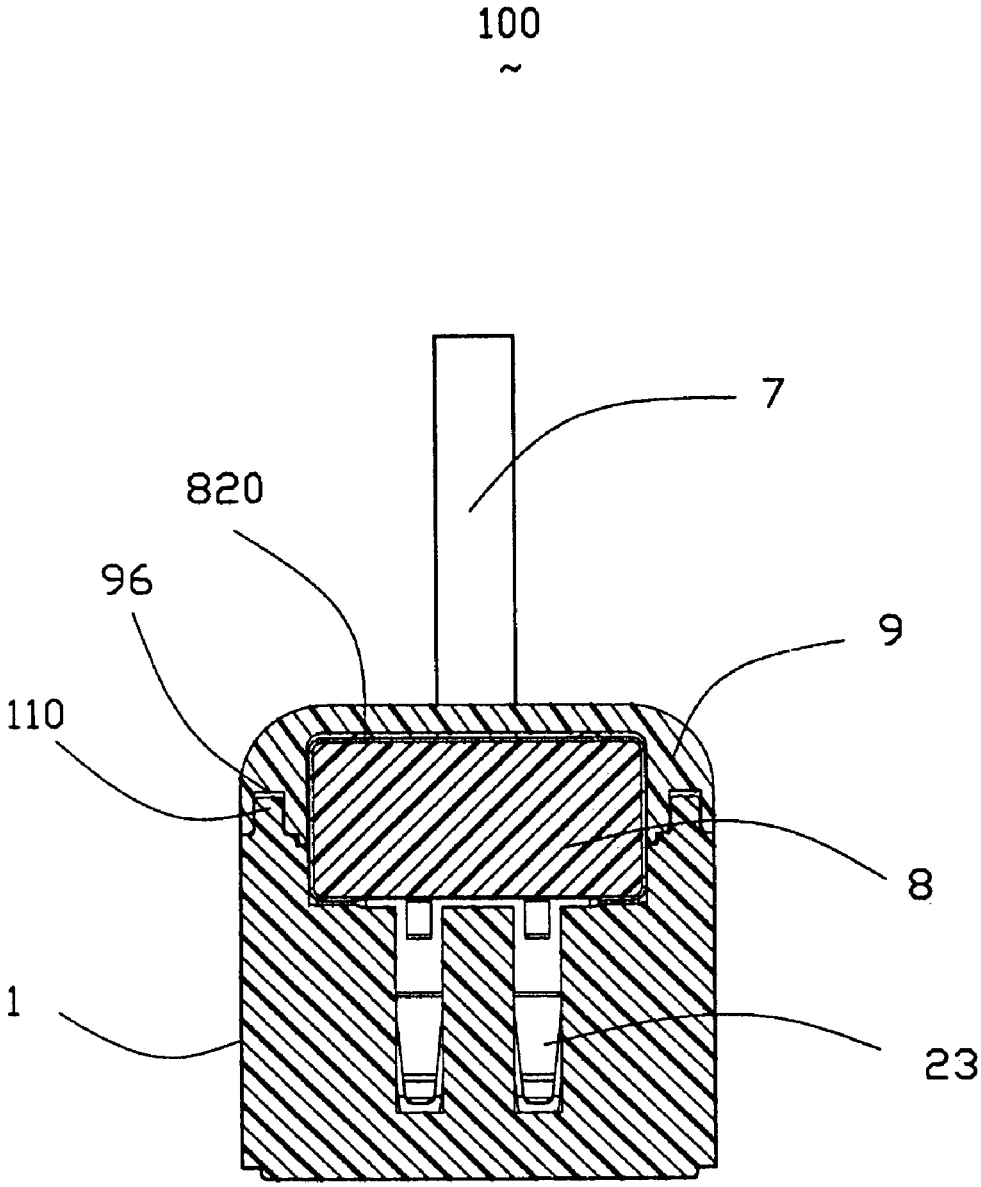
FIG. 10 is a cross sectional view of the electrical connector assembly of FIG. 1 taken along line 10-10 of FIG. 1.

Referring to FIGS. 4-5 in conjunction with FIG. 9, the spacer 6 with a T-shaped structure comprises a main portion 60. The main portion 60 defines a plurality of first contact channels 61 recessed from one surface thereof for allowing corresponding first tail ends 42 of the first contacts 4 received therein, a plurality of second contact channels 62 recessed from the other surface thereof for allowing corresponding second tail ends 52 of the second contacts 5 received therein, and a pair of flanges 63 disposed at two sides thereof and respectively received in corresponding guiding slits 332 for providing a reliable connection therebetween.

Referring to FIG. 5, the cable 7 comprises a plurality of wires 70. Each wire 70 comprises a conductor 72 for transmitting signal, and an insulative jacket surrounding the conductor 72 for provided sheath.

Figure 7:
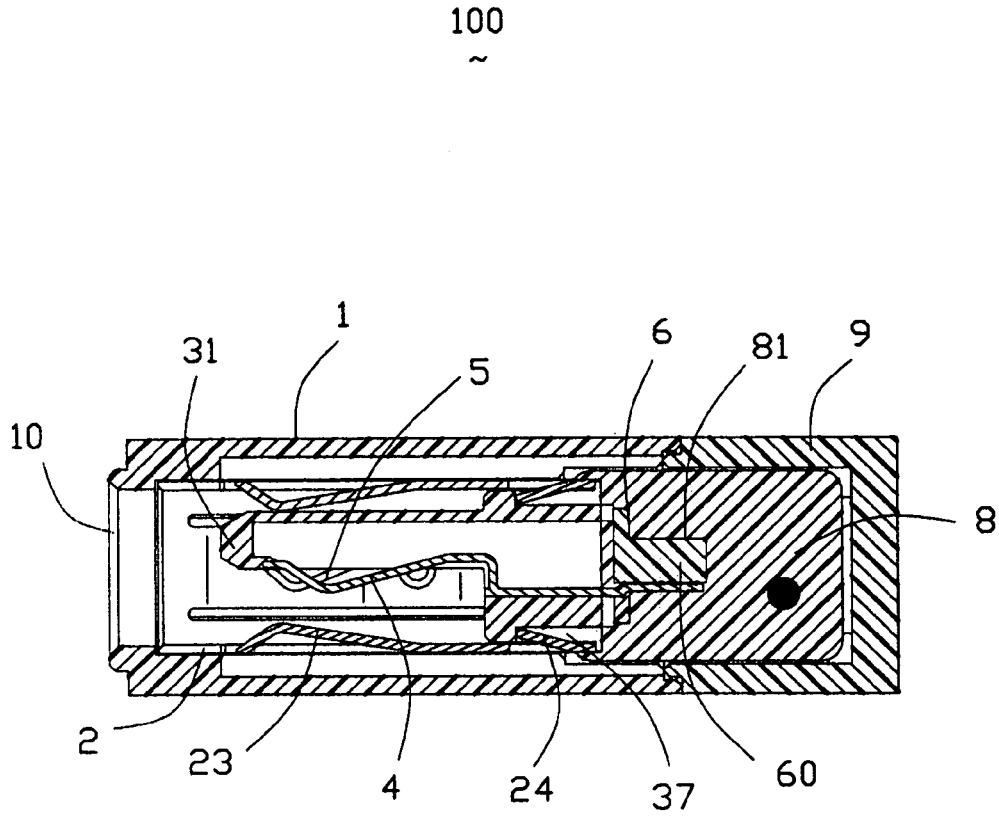
FIG. 7 is a cross sectional view of the electrical connector assembly of FIG. 1 taken along line 7-7 of FIG. 1.
Figure 8:
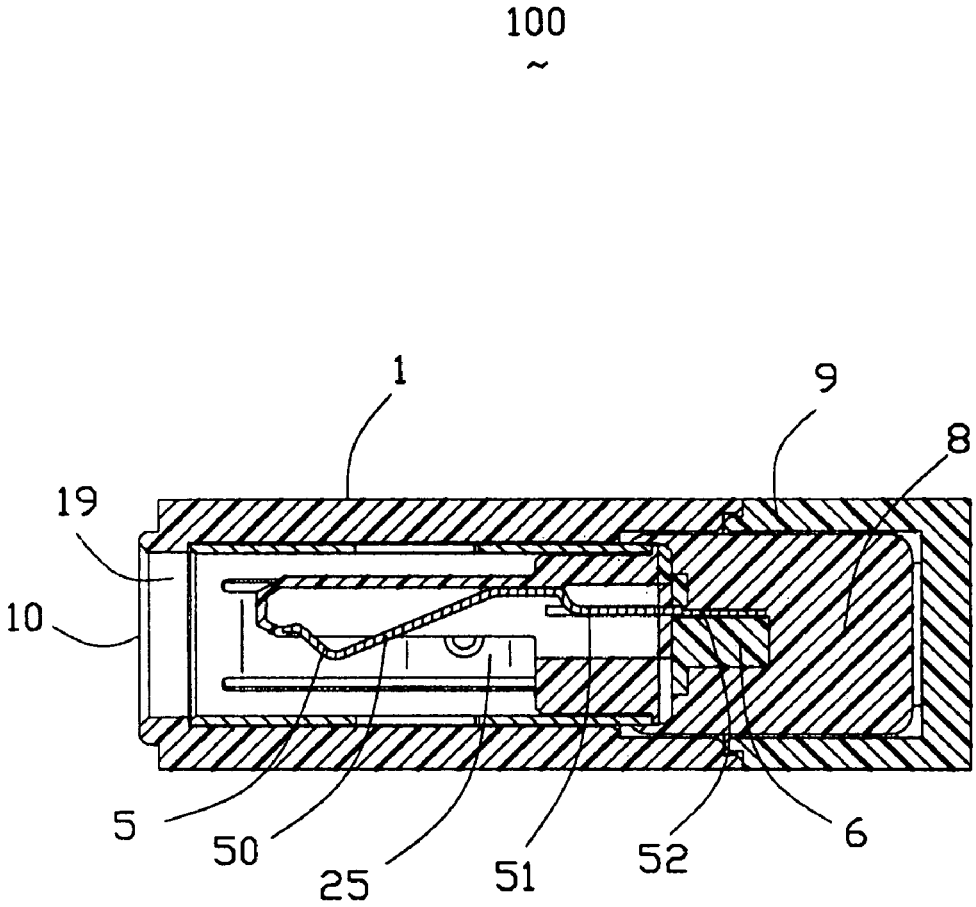
FIG. 8 is a cross sectional view of the electrical connector assembly of FIG. 1 taken along line 8-8 of FIG. 1.

Referring to FIGS. 4-5 in conjunction with FIG. 7, the casing 8 with a generally rectangular configuration comprises a base 80. The base 80 defines an opening 81 for partially enclosing the rear end of the connector body 200, the spacer 6 and the front end of the cable 7, and a cable channel 821 communicating with the opening 81 for allowing the cable 7 extending therethrough, and a plurality of bars 820 disposed on the rear surface 82.

Referring to FIGS. 2-3, the insulative cover 9 comprises a second front surface 94, a second rear surface 95 opposite to the second front surface 94, a main body 90 disposed between the second front surface 94 and the second rear surface 95, and a pair of locking members 92 extending forwardly from the second front surface 94 and located adjacent to opposite lateral sides of the main body 90. The main body 90 defines a cavity 91 for partially receiving the casing 8 therein, a plurality of recesses 96 depressed from the second front surface 94 towards the second rear surface 95 and respectively aligning with corresponding posts 110 of the first insulative housing 1, and a cable channel 93 extending forwardly from the second rear surface 95 and communicating with the cavity 91 for allowing the cable 7 extending therethrough.

In assembly, referring to FIGS. 1-10, the first and second contacts 4, 5 are firstly and respectively inserted in corresponding first and second contact receiving passageways 32, 34 of the second insulative housing 3 until the first and second mating ends 40, 50 are respectively received in corresponding first and second contact slots 310, 312, with the first and second stings 410, 510 of the first and second retention portions 41, 51 interferentially abutting with the inner walls of the first and second contact receiving passageways 32, 34 for provided a reliable orientation therebetween. Then, the spacer 6 is pushed and engaged with the second insulative housing 3, with the first and second tail ends 42, 52 of contacts 4, 5 received in corresponding contact channels 61, 62 of the spacer 6 and the flanges 63 respectively received in corresponding guiding slots 332 of the second insulative housing 3 for securing them reliably. The spacer 6 substantially seals the first and second contact receiving passageways 32, 34 and efficiently prevents the melting plastic material of the casing 8 in a later molding process from entering into the first and second contact receiving passageways 32, 34 and influencing the electrical connection between the electrical connector assembly 100 and the complementary connector.

Subsequently, above assembly is pushed and received into the shielding member 2, with the base 30 and the tongue 31 are together received in the third cavity 27 until the baffle 35 of the second insulative housing 3 abutting against the shielding member 2 for avoiding an excessive insertion. In addition, during insertion process, the second resilient pieces 24 of the shielding member 2 are respectively engaging with corresponding locking slots 37 for preventing the second insulative housing 3 moving rearwardly, the ribs 36 of the second insulative housing 3 are tightly abutting against the inner surfaces of the shielding member 2 for providing a reliable connection therebetween. The locking barbs 26 respectively slide along corresponding restricted slits 330, and bent inwardly to lock with the locking slits 330 and the rear end of the flanges 63 of the spacer 6 after the insulative housing 3 abuts against the shielding member 2 for fastening these three elements together. Attentively, the first resilient pieces 23 of the shielding member 2 may engage with the complementary connector in a direction perpendicular to the rear-to-front direction, similarly, the third resilient pieces 25 of the shielding member 2 may engage with the complementary connector in another direction perpendicular to said direction and the rear-to-front direction, thereby providing a reliable connection therebetween.

Then, the cable 7 is soldered to the contacts, either the first contacts 4 or the second contacts 5, even all of the first and second contacts 4, 5. The first contact 4 is used to transmit a first signal, dissimilarly, some second contacts 5 are used to transmit a second signal, such as audio signal, and the remaining second contacts 5 are used to transmit other signals according to the advanced purpose. In view of the above explanation, according to the advanced purpose, the cable 7 is soldered to either the first tail ends 42 of first contacts 4 or the second tail ends 52 of second contacts 5 selectively. In this embodiment, the electrical connector assembly 100 is supposed to transmit a first signal. So, the conductors 72 of cable 7 should respectively connect with the first tail ends 42 of the first contact 4.

Subsequently, molding the casing 8. The casing 8 is designed to envelop the rear end of connector body 200, the spacer 6, the front end of the cable 7, and the joints between the contacts and the cable 7, for provided a reliable connection therebetween.

Then, inserting above assembly into the first insulative housing 1. The connector body 200, the spacer 6 and the casing 8 are respectively received in the first cavity 19 and the second cavity 12 until the shielding member 2 abuts against the restrictive portions 16 for preventing the connector body 200 from inserting excessively. It is noted that, a rear part of the casing 8 is exposed beyond the first rear surface 11 of the first insulative housing 1.

Lastly, assembling the insulative cover 9 with the first insulative housing 1 in the rear-to-front direction. In this assemble process, the cavity 91 of the insulative cover 9 encloses the exposed casing 8, the cable 7 extends through the cable channel 93, the locking members 92 respectively slide along the first channels 18 until the locking members 92 lock with corresponding locking portions 150 so as to secure the first insulative housing 1 and the insulative cover 9 together, the posts 110 of the first insulative housing 1 are respectively received in corresponding recesses 96 of the insulative cover 9 with the ribs 111 abutting against the inner surface of the recesses 96 for providing alternative way to secure the first insulative housing 1 and the insulative cover 9 together. After assembly, the bars 820 of casing 8 abut against the insulative cover 9 for providing a retention function therebetween. In this embodiment, the locking members 92 and the locking portions 150, which functioned as a locking mechanism, provide a retention connection therebetween. Similarly, the posts 110 and the recesses 96 can function as a locking mechanism.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

a first insulative housing;

a connector body received in the first housing, and comprising a shielding member, a second insulative housing received in the shielding member and a plurality of contacts received in the second insulative housing;

a cable including a plurality of conductors electrically connected with at least a contact;

an insulative cover assembled to the first insulative housing in a rear-to-front direction; wherein said insulative cover and said insulative first housing together define a locking mechanism for providing a reliable connection therebetween.

2. The electrical connector assembly as described in claim 1, wherein the first insulative housing comprises a top wall, a bottom wall opposite to the top wall, and a pair of lateral walls connected with the top wall and bottom wall, these walls together define a cavity for wholly receiving the connector body therein.

3. The electrical connector assembly as described in claim 1, wherein the locking mechanism is composed of a locking portion formed on the first insulative housing and a locking member formed on the insulative coves the locking member locks with the locking portion for assuring a reliable assembly.

4. The electrical connector assembly as described in claim 1, wherein the locking mechanism is composed of a post formed on the first insulative housing and a recess formed in the insulative cover, the post interferentially engages with the recess for assuming a reliable assembly.

5. The electrical connector assembly as described in claim 1, wherein the shielding member comprises a locking barb, the second insulative housing comprises a locking slit, the locking barb is bent inwardly to locking with the locking slit for assembling the shielding member and the second insulative housing together.

6. The electrical connector assembly as described in claim 5, wherein the electrical connector assembly further comprises a spacer assembled with the second insulative housing for sealing the rear end of the second insulative housing for preventing the melting plastic material from entering in.

7. The electrical connector assembly as described in claim 6, wherein the spacer comprises a flange disposed at two sides thereof the second insulative housing comprises a guiding slit for guiding an insertion of the flange and receiving the flange therein.

8. The electrical connector assembly as described in claim 7, wherein the locking barb of the shielding member also locking the rear end of the spacer for fastening the spacer with the second insulative housing and the shielding member.

9. The electrical connector assembly as described in claim 8, wherein the shielding member comprises a third resilient piece extending inwardly thereof the second insulative housing defines a locking slot for allowing the resilient piece abutting against for preventing the insulative housing moving rearwardly.

10. The electrical connector assembly as described in claim 9, wherein the shielding member comprises a first resilient piece extending inwardly thereof for abutting against the complementary connector in a direction perpendicular to the rear-to-front direction.

11. The electrical connector assembly as described in claim 10, the shielding member comprises a second resilient piece extending inwardly thereof for abutting against the complementary connector in another direction perpendicular to said direction and the rear-to-front direction.

12. The electrical connector assembly as described in claim 11, wherein the electrical connector assembly further comprises a casing with parts thereof received in the insulative housing for partially enclosing the rear end of the connector body, the spacer and the front end of the cable.

13. The electrical connector assembly as described in claim 12, wherein the first insulative housing defines a restrictive portion for preventing the connector body to be inserted excessively.

14. The electrical connector assembly as described in claim 13, wherein the contacts comprises a plurality of first contacts and a plurality of second contacts, the cable is soldered to either the first contacts or second contacts selectively for transmitting different signals according to advanced purpose.

15. The electrical connector assembly as described in claim 14, wherein the second insulative housing defines a restricted slit for allowing the locking barb of the shielding member sliding thereon.

16. An electrical connector assembly comprising:

a connector housing including a top wall, a bottom wall, and two opposite lateral walls, which together define a cavity;

a connector body wholly received cavity and including a shielding member, an insulative housing received in shielding member and a plurality of contacts received in the insulative housing;

a cable including a plurality of conductive wires electrically connected to the contacts; and a cover assembled to the connector housing in a rear-to-front direction for enclosing the connector body therebetween.

17. The electrical connector assembly as described in claim 16, wherein the cover defines a pair of locking members extending outwardly and forwardly therefrom, the connector housing defines a pair of locking portions for allowing the locking members to engage with.

18. The electrical connector assembly as described in claim 1, wherein a front surface of the shielding member is located behind a mating interface of the first connector housing when viewed along a front-to-rear direction.

19. An electrical connector assembly comprising:

an insulative housing including a base and a tongue extending forwardly therefrom;

a plurality of contact-receiving passageways formed in both said base and said tongue;

a plurality of first contacts and a plurality of second contacts disposed in the corresponding passageways, respectively, and arranged in an alternate manner wherein the first contact is wider than the second contact while the second contact is longer than the first contact;

tails of the first contacts arranged in a first row, and tails of the second contacts being arranged n a second row spaced from the first row with a spacer therebetween; and a cable including a plurality of wires mechanically and electrically connected to the tails of said first contacts and those of said second contacts, respectively.

* * * * *